US005637065A

United States Patent [19]

Chang

[11] Patent Number: 5,637,065

[45] Date of Patent: Jun. 10, 1997

[54] MASSAGE EXERCISE BAR DEVICE

[76] Inventor: Sreter Chang, No. 451, Ta Tien Rd., Homei Chen, Chang Hua Hsien, Taiwan

[21] Appl. No.: 687,174

[22] Filed: Jul. 25, 1996

[51] Int. Cl.[6] ..... A63B 23/14; A61H 15/00

[52] U.S. Cl. ..... 482/114; 482/46; 482/1; 601/72

[58] Field of Search ..... 482/1, 45, 46, 482/110, 114, 116, 131, 132; 601/70, 72, 46, 67, 78, 80, 118–121

[56] References Cited

U.S. PATENT DOCUMENTS

| | | | |
|---|---|---|---|
| 3,830,493 | 8/1974 | Miller | 482/46 |
| 4,433,683 | 2/1984 | McCoy et al. | 601/120 |
| 5,123,406 | 6/1992 | Masuda | 601/120 X |

*Primary Examiner*—Richard J. Apley
*Assistant Examiner*—John Mulcahy
*Attorney, Agent, or Firm*—Beveridge, DeGrandi, Weilacher & Young LLP

[57] ABSTRACT

An exercise bar device comprises a first hollow bar, a second hollow bar, a massage sleeve extending proximally from the second hollow bar, a first foam tube enclosing the first hollow bar, a second foam tube enclosing the second hollow bar, a switch cover covering a distal end of the second hollow bar, a hexagonal rod inserted in the first hollow bar, a brake ring and a friction disk disposed on the hexagonal rod, a nut engaging with an outer thread of a threaded end of the hexagonal rod, a large number of protrusions disposed on an outer periphery of the massage sleeve, an inner sleeve disposed in the massage sleeve and connected to the second hollow bar, a spacing defined between the second hollow bar and the massage sleeve, a motor disposed in the inner sleeve, and a coiled spring and an elastic plate disposed in the spacing. The first hollow bar has an end disk. The end disk couples with the elastic plate. The rod is rotated to increase or decrease the torsion resistance between the hollow bars.

2 Claims, 3 Drawing Sheets

MASSAGE EXERCISE BAR DEVICE

BACKGROUND OF THE INVENTION

The invention relates to an exercise bar device. More particularly, the invention relates to an exercise bar device which can massage the user while exercising.

Most wrist exercisers cannot be converted to massage devices. Therefore, the user has to use both a wrist exerciser first and a massage device later after a long period of exercising.

SUMMARY OF THE INVENTION

An object of the invention is to provide an exercise bar device which can massage the user simultaneously while exercising.

Accordingly, an exercise bar device comprises a first hollow bar, a second hollow bar, a massage sleeve extending proximally from the second hollow bar, a first foam tube enclosing the first hollow bar, a second foam tube enclosing the second hollow bar, and a switch cover covering a distal end of the second hollow bar. A hexagonal rod is inserted in the first hollow bar. A distal end of the hexagonal rod is inserted in a distal end of the first hollow bar, a steel washer, a ball bearing, a steel spacer and a hexagonal hole of a rotating cover. A bolt fastens the rotating cover and the distal end of the hexagonal rod together. The ball bearing has a plurality of through holes to receive a plurality of balls. A brake ring and a friction disk are disposed on the hexagonal rod. A nut engages with a threaded end of the hexagonal rod. The friction disk is disposed between the brake ring and the nut. The friction disk has a hexagonal seat abutting the nut. A large number of protrusions are disposed on an outer periphery of the massage sleeve. An inner sleeve is disposed in the massage sleeve and connected to the second hollow bar. A spacing is defined between the second hollow bar and the massage sleeve. A coiled spring and an elastic plate are disposed in the spacing. A post connects an end of the elastic plate. The post is placed between the elastic plate and the coiled spring. A positioning recess is formed in an outer periphery of the inner sleeve to receive the post. A groove and a recess are formed in the inner sleeve. A hollow separator separates the groove and the recess. A tip of the threaded end of the hexagonal rod passes through the hollow separator. The tip of the threaded end of the hexagonal rod is retained by a retaining ring. The retaining ring is disposed in the recess. The nut is disposed in the groove. A motor connects an eccentric disk. The motor and the eccentric disk are disposed in the recess. A chamber is formed in the second hollow bar. A compression spring and an L-shaped copper plate are disposed in the chamber. An end of the L-shaped copper plate abuts the motor. A contact spring and a circuit are disposed in the switch cover. A plurality of batteries are disposed between the contact spring and the compression spring. The first hollow bar has an end disk. A large number of radiating blocks are disposed in the end disk. The end disk couples with the massage sleeve. The nut can be moved along the threaded end of the hexagonal rod. When the rotating cover is rotated counterclockwisely, the nut is moved toward the hollow separator. Thus the friction disk disengages from the brake ring to actuate an idle running between the first hollow bar and the second hollow bar. The nut can be moved toward the friction disk along the threaded end of the hexagonal rod while the rotating cover is rotated clockwisely. Thus the friction disk engages with the brake ring. The friction disk pushes the second hollow bar to move toward the first hollow bar closely. Thus the torsion resistance between the first hollow bar and the second hollow bar is increased. The switch cover can be rotated to initiate the motor to rotate the eccentric disk. The first hollow bar and the second hollow bar will be vibrated by the eccentric disk. Thus the vibrating protrusions can perform a massage function.

DETAILED DESCRIPTION OF THE INVENTION

Figures 1, 1A:
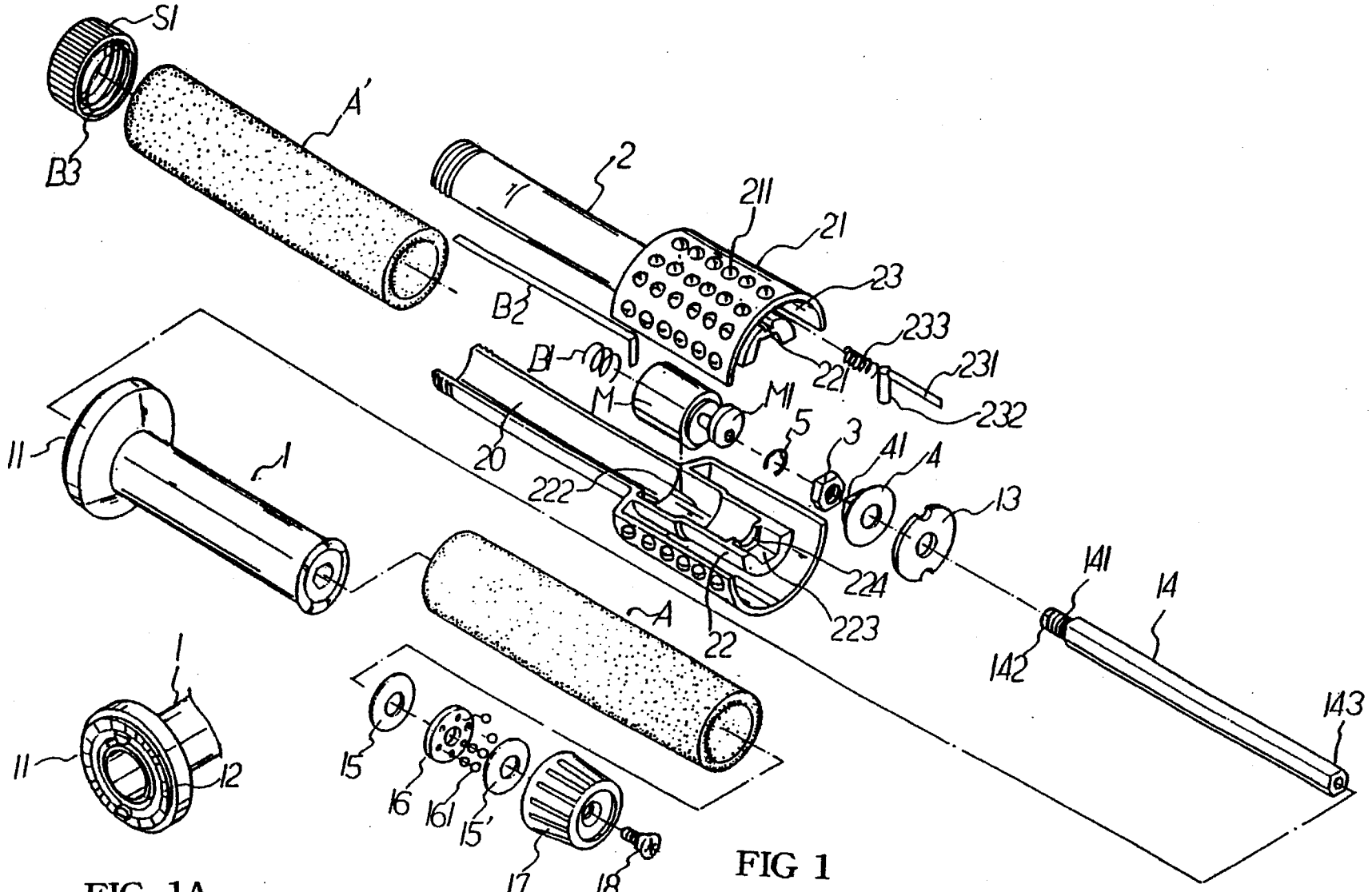
FIG. 1 is a perspective exploded view of an exercise bar device of a preferred embodiment in accordance with the invention.
FIG. 1A is a partially perspective view of a first hollow bar.
Figure 2:
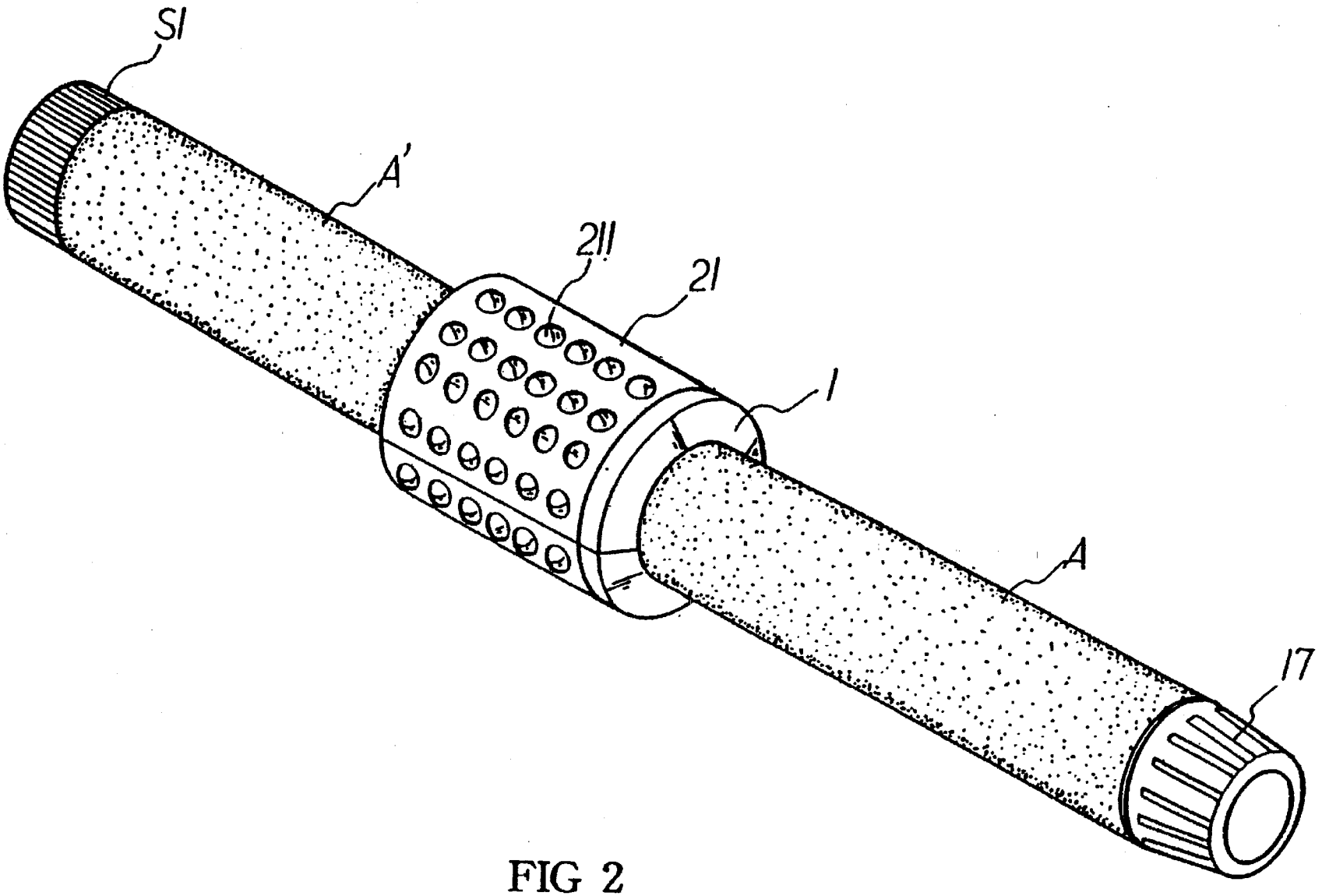
FIG. 2 is a perspective assembly view of FIG. 1.
Figure 4:
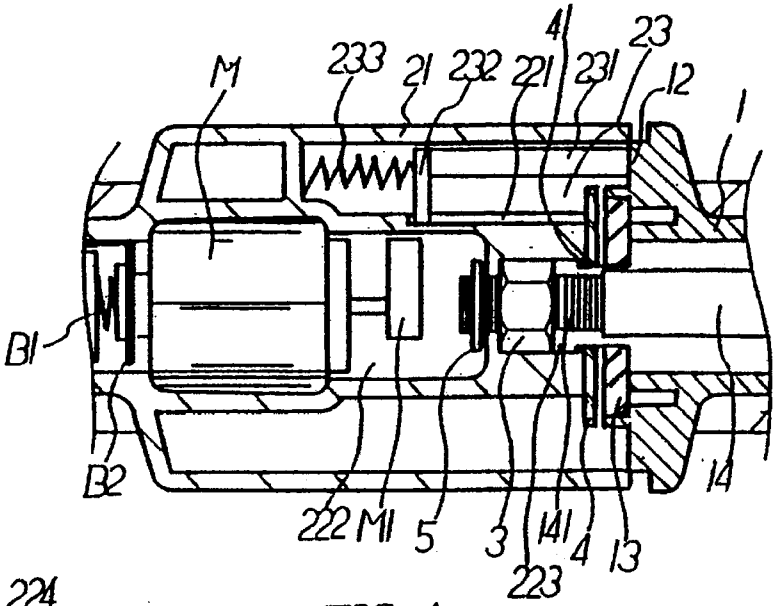
FIG. 4 is a schematic view illustrating a brake ring disengaging from a friction disk.
Figure 5:
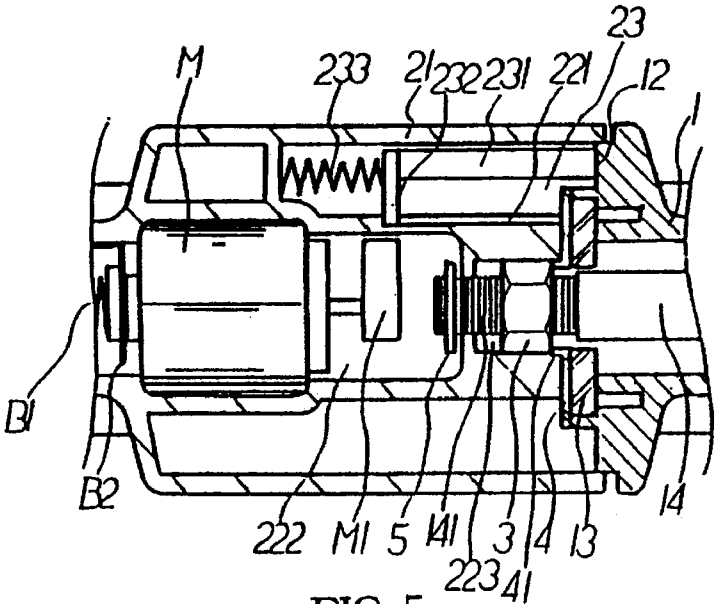
FIG. 5 is a schematic view illustrating a brake ring engaging with a friction disk.
Figure 3:
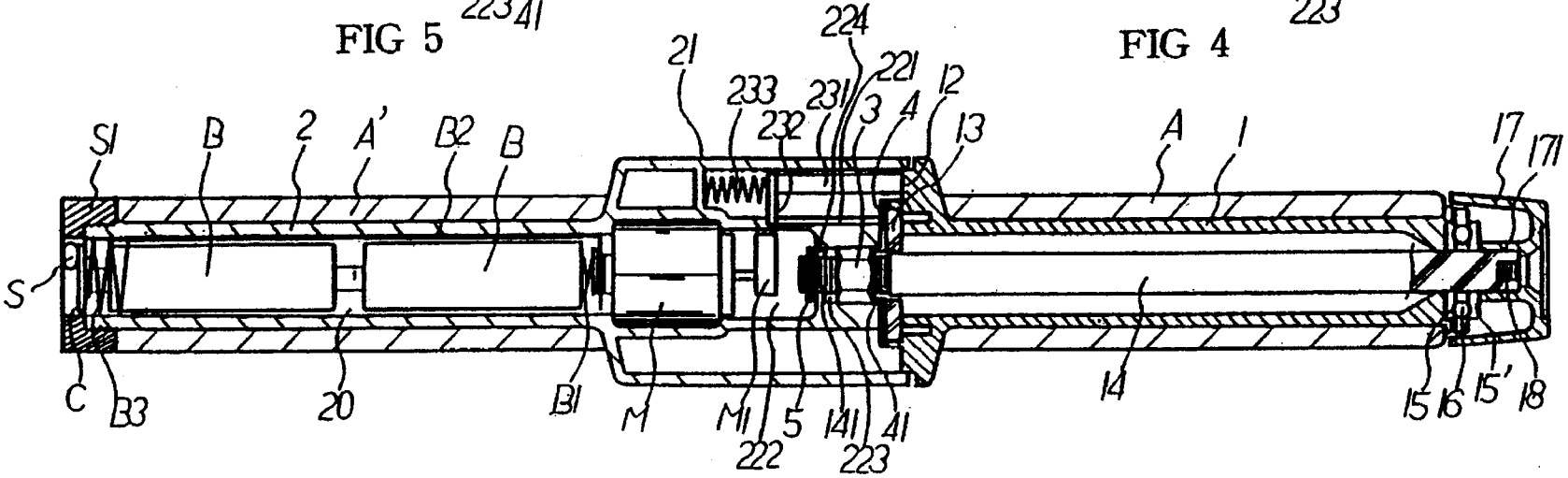
FIG. 3 is a sectional view of FIG. 2.

Referring to FIGS. 1 to 3, an exercise bar device comprises a first hollow bar 1, a second hollow bar 2, a massage sleeve 21 extending proximally from the second hollow bar 2, a first foam tube A enclosing the first hollow bar 1, a second foam tube A' enclosing the second hollow bar 2, and a switch cover S1 covering a distal end of the second hollow bar 2. A hexagonal rod 14 is inserted in the first hollow bar 1. A distal end 143 of the hexagonal rod 14 is inserted in a distal end of the first hollow bar. A steel washer 15, a ball bearing 16 and a steel spacer 15' and a hexagonal hole 171 of a rotating cover 17 surround the hexagonal rod 14. A bolt 18 fastens the rotating cover 17 and the distal end 143 of the hexagonal rod 14 together. The ball bearing 16 has a plurality of through holes to receive a plurality of balls 161. The balls 161 can retard the friction of the first hollow bar 1. A brake ring 13 and a friction disk 4 are disposed on the hexagonal rod 14. A nut 3 engages with a threaded end 141 of the hexagonal rod 14. The friction disk 4 is disposed between the brake ring 13 and the nut 3. The friction disk 4 has a hexagonal seat 41 abutting the nut 3. A large number of protrusions 211 are disposed on an outer periphery of the massage sleeve 21. An inner sleeve 22 is disposed in the massage sleeve 21 and connected to the second hollow bar 2. A spacing 23 is defined between the second hollow bar 2 and the inner sleeve 22. A coiled spring 233 and an elastic plate 231 are disposed in the spacing 23. A post 232 connects an end of the elastic plate 231. The post 232 is placed between the elastic plate 231 and the coiled spring 233. A positioning recess 221 is formed in an outer periphery of the inner sleeve 22 to receive the post 232. A groove 223 and a recess 222 are formed in the inner sleeve 22. A hollow separator 224 separates the groove 223 and the recess 222. A tip 142 of the threaded end 141 of the hexagonal rod 14 passes through the hollow separator 224. The tip 142 of the threaded end 141 of the hexagonal rod 14 is retained by a retaining ring 5. The retaining ring 5 is disposed in the recess 222. The nut 3 is disposed in the groove 223. A motor M connects an eccentric disk M1. The motor M and the eccentric disk M1 are disposed in the recess 222. A chamber 20 is formed in the second hollow bar 2. A compression spring B1 and an L-shaped copper plate B2 are disposed in the chamber 20. An end of the L-shaped copper plate B2 abuts the motor M. A contact spring B3 and a circuit C are disposed in the switch cover S1. A plurality of batteries B are disposed between the contact spring B3 and the compression spring B1. The first hollow bar 1 has an end disk 11. A large number of radiating blocks 12 are disposed in the end disk 11. The end disk 11 couples with the elastic plate 231.

Referring to FIGS. 1 to 4, the nut 3 can be moved along the threaded end 141 of the hexagonal rod 14. When the rotating cover 17 is rotated counterclockwisely, the nut 3 is moved toward the hollow separator 224. Thus the friction disk 4 disengages from the brake ring 13 to actuate an idle running between the first hollow bar 1 and the second hollow bar 2.

Referring to FIGS. 1 to 3 and 5, the nut 3 can be moved toward the friction disk 4 along the threaded end 141 of the hexagonal rod 14 while the rotating cover 17 is rotated clockwisely. Thus the friction disk 4 engages with the brake ring 13. The friction disk 4 pushes the second hollow bar 2 to move toward the first hollow bar 1 closely. Thus the torsion resistance between the first hollow bar 1 and the second hollow bar 2 is increased.

Referring to FIGS. 1 to 3, the switch cover S1 can be rotated to initiate the motor M to rotate the eccentric disk M1. The first hollow bar 1 and the second hollow bar 2 will be vibrated by the eccentric disk M1. Thus the vibrating protrusions 211 can massage the user.

The invention is not limited to the above embodiment but various modification thereof may be made. Further, various changes in form and detail may be made without departing from the scope of the invention.

I claim:

1. A massage exercise bar device comprising:

a first hollow bar, a second hollow bar, a massage sleeve extending from the second hollow bar, a first foam tube enclosing the first hollow bar, a second foam tube enclosing the second hollow bar, and a switch cover covering a distal end of the second hollow bar;

a hexagonal rod inserted in the first hollow bar, a distal end of the rod inserted in a distal end of the first hollow bar;

a bolt fastening a rotating cover to the distal end of the rod;

a brake ring and a friction disk disposed on the rod, a nut engaging with a proximal threaded end of the rod, the friction disk disposed between the brake ring and the nut;

a large number of protrusions disposed on an outer periphery of the massage sleeve;

an inner sleeve disposed in the massage sleeve and connected to the second hollow bar, a spacing defined between the second hollow bar and the inner sleeve, a coiled spring and an elastic plate disposed in the spacing, a post connected to an end of the elastic plate, the post placed between the elastic plate and the coiled spring, a positioning recess formed in an outer periphery of the inner sleeve to receive the post;

a groove and a recess formed in the inner sleeve, a hollow separator separating the groove and the recess, a tip of the threaded end of the rod passing through the hollow separator and retained by a retaining ring disposed in the recess, the nut disposed in the groove;

a motor connected to an eccentric disk, the motor and the eccentric disk disposed in the recess;

a chamber formed in the second hollow bar, a compression spring and an L-shaped copper plate disposed in the chamber, an end of the L-shaped copper plate abutting the motor, a contact spring and a circuit disposed in the switch cover, a plurality of batteries disposed between the contact spring and the compression spring;

the first hollow bar having an end disk, a large number of radiating blocks disposed in the end disk which couple with the elastic plate;

wherein the switch cover is rotated to initiate the motor to rotate the eccentric disk to vibrate the first hollow bar and the second hollow bar;

wherein the rotating cover is rotated in a first sense to move the nut toward the hollow separator along the threaded end of the rod so that the friction disk disengages from the brake ring to decrease a torsion resistance between the first hollow bar and the second hollow bar; and wherein the rotating cover is rotated in the opposite sense to move the nut toward the friction disk along the threaded end of the rod so that the friction disk engages with the brake ring to increase the torsion resistance between the first hollow bar and the second hollow bar.

2. A massage exercise bar comprising:

a first hollow bar, a second hollow bar, a massage sleeve extending from the second hollow bar;

a rod inserted in the first hollow bar, a distal end of the rod inserted in a distal end of the first hollow bar;

a rotating cover connected to the distal end of the rod;

a brake ring and a friction disk disposed on the rod, a nut engaging with a proximal threaded end of the rod, the friction disk disposed between the brake ring and the nut;

an inner sleeve disposed in the massage sleeve and connected to the second hollow bar, a groove and a recess formed in the inner sleeve, a hollow separator separating the groove and the recess, a tip of the threaded end of the rod passing through the hollow separator and retained by a retaining ring disposed in the recess, the nut disposed in the groove;

a motor connected to an eccentric disk, the motor and the eccentric disk disposed in the recess;

a power source for powering the motor and a switch for turning the motor on and off;

wherein the rotating cover is rotated in a first sense to move the nut toward the hollow separator along the groove so that the friction disk disengages from the brake ring to decrease a torsion resistance between the first hollow bar and the second hollow bar; and wherein the rotating cover is rotated in the opposite sense to move the nut toward the friction disk along the groove so that the friction disk engages with the brake ring to increase the torsion resistance between the first hollow bar and the second hollow bar.

* * * * *